US008152585B2

(12) United States Patent
Nishimura et al.

(10) Patent No.: US 8,152,585 B2
(45) Date of Patent: Apr. 10, 2012

(54) METHOD FOR MANUFACTURING PLASMA DISPLAY PANEL

(75) Inventors: Masaki Nishimura, Osaka (JP); Koyo Sakamoto, Osaka (JP); Ryousuke Sawa, Osaka (JP)

(73) Assignee: Panasonic Corporation, Osaka (JP)

( * ) Notice: Subject to any disclaimer, the term of this patent is extended or adjusted under 35 U.S.C. 154(b) by 78 days.

(21) Appl. No.: 12/739,845

(22) PCT Filed: Nov. 10, 2009

(86) PCT No.: PCT/JP2009/005968

§ 371 (c)(1),
(2), (4) Date: Apr. 26, 2010

(87) PCT Pub. No.: WO2010/055634

PCT Pub. Date: May 20, 2010

(65) Prior Publication Data

US 2011/0159772 A1 Jun. 30, 2011

(30) Foreign Application Priority Data

Nov. 11, 2008 (JP) ..... 2008-288433

(51) Int. Cl.
*H01J 9/00* (2006.01)

(52) U.S. Cl. ..... 445/25; 445/24

(58) Field of Classification Search ..... 445/24, 445/25

See application file for complete search history.

(56) References Cited

U.S. PATENT DOCUMENTS

| | | | | |
|---|---|---|---|---|
| 6,533,630 | B1 | 3/2003 | Terajima et al. | |
| 6,817,917 | B1 * | 11/2004 | Kado et al. | 445/25 |
| 7,070,471 | B2 * | 7/2006 | Shiokawa et al. | 445/24 |
| 2004/0053555 | A1 * | 3/2004 | Sasaki et al. | 445/25 |
| 2005/0037684 | A1 * | 2/2005 | Kado et al. | 445/24 |
| 2007/0170856 | A1 | 7/2007 | Cha | |
| 2007/0170865 | A1 | 7/2007 | Park | |

FOREIGN PATENT DOCUMENTS

| | | | |
|---|---|---|---|
| JP | 11-306961 | | 11/1999 |
| JP | 2000-156160 | | 6/2000 |
| JP | 2003-317621 | | 11/2003 |
| JP | 2005-276712 | | 10/2005 |
| JP | 2005276712 | A * | 10/2005 |
| JP | 2006-244784 | | 9/2006 |
| JP | 2007-200886 | | 8/2007 |
| JP | 2007200886 | A * | 8/2007 |
| JP | 2007-317488 | | 12/2007 |
| JP | 2009-277519 | | 11/2009 |
| WO | 2008/136055 | | 11/2008 |

OTHER PUBLICATIONS

International Search Report issued Dec. 15, 2009 in International (PCT) Application No. PCT/JP2009/005968.

* cited by examiner

*Primary Examiner* — Mariceli Santiago
(74) *Attorney, Agent, or Firm* — Wenderoth, Lind & Ponack, LLP.

(57) ABSTRACT

The present invention provides a method for manufacturing a plasma display panel having a front plate provided with a front substrate, a display electrode formed on the front substrate, a dielectric layer covering the display electrode, and a protective layer covering the dielectric layer. In the method above, after the protective layer has been formed, the front plate is processed in a moisture-free atmosphere for only a period where the front plate has a temperature of 400° C. or lower.

6 Claims, 9 Drawing Sheets

METHOD FOR MANUFACTURING PLASMA DISPLAY PANEL

THIS APPLICATION IS A U.S. NATIONAL PHASE APPLICATION OF PCT INTERNATIONAL APPLICATION PCT/JP2009/005968.

TECHNICAL FIELD

The present invention relates to a method for manufacturing an AC-type surface discharge plasma display panel used for a plasma display device.

BACKGROUND ART

An AC-type surface discharge plasma display panel has become dominant in plasma display panels (hereinafter simply referred to as a panel). A panel contains a front plate and a back plate oppositely disposed with each other and a plurality of discharge cells therebetween. The front plate has a glass-made front substrate, display electrodes each of which is formed as a pair of a scan electrode and a sustain electrode, and over which, a dielectric layer and a protective layer are formed to cover the display electrodes. The protective layer not only generates initial electrons for stable discharge but also protects the dielectric layer from sputtering by ions generated by the discharge. The back plate has a glass-made back substrate, data electrodes, a dielectric layer for covering the data electrodes, barrier ribs, and phosphor layers. The front plate and the back plate are oppositely disposed and sealed with each other in a manner that the display electrodes and the data electrodes cross with each other via a discharge space formed inside. The discharge space is filled with discharge gas. Discharge cells are formed at positions where the display electrodes face the data electrodes. In the panel structured above, a gas discharge is generated selectively in each discharge cell, by which phosphors of red, green, and blue are excited. Color image display is thus attained (see patent literature 1).

In the panel, as described above, the protective layer not only generates initial electrons for stable discharge but also protects the dielectric layer from sputtering by ions generated by the discharge. That is, stabilizing the characteristics of the protective layer allows a panel to have excellent image display.

Patent Literature

Patent literature 1: Unexamined Japanese Patent Publication No. 2003-131580

SUMMARY OF THE INVENTION

The present invention provides a method for manufacturing a panel having a front plate with the following components: a front substrate; display electrodes formed on the front substrate; a dielectric layer formed so as to cover the display electrodes; and a protective layer formed so as to cover the dielectric layer. In the method above, after the protective layer has been formed, the front plate is processed under moisture-free atmosphere only for the period where the front plate has a temperature of 400° C. or lower.

REFERENCE MARKS IN THE DRAWINGS

Figure 1:
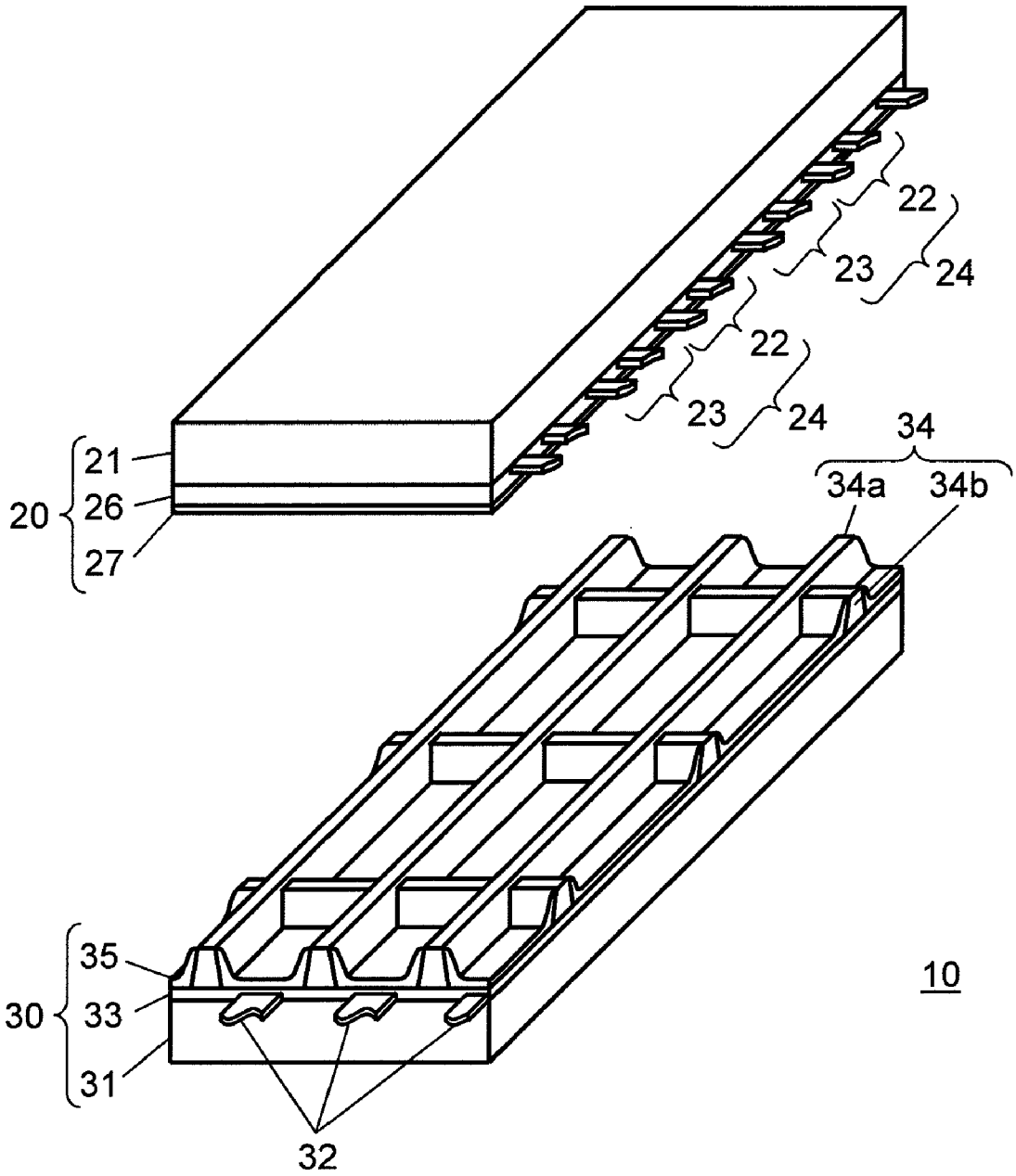
FIG. 1 is an exploded perspective view of a panel in accordance with an exemplary embodiment of the present invention.

10 panel
20 front plate
21 front substrate
22 scan electrode
23 sustain electrode
24 display electrode
26 dielectric layer
27 protective layer
27*a* base protective layer
27*b* particle layer
28 single-crystal particle
29 aggregated particle
30 back plate
31 back substrate
32 data electrode
33 dielectric layer
34 barrier ribs
34*a* vertical ribs
34*b* horizontal ribs
35 phosphor layer
221, 222. 223 bus electrode (scan electrode)
221*c*, 222*c*, 231*c*, 232*c* black layer
221*d*, 222*d*, 231*d*, 232*d* conductive layer
231, 232, 233 bus electrode (sustain electrode)

DETAILED DESCRIPTION OF THE PREFERRED EMBODIMENTS

Hereinafter, a method for manufacturing a panel in accordance with an exemplary embodiment of the present invention will be described with reference to drawings.

First Exemplary Embodiment

FIG. 1 is an exploded perspective view schematically showing the structure of a panel manufactured by the manufacturing method in accordance with the exemplary embodiment of the present invention. Panel 10 has a structure where front plate 20 and back plate 30 are oppositely disposed and sealed at the peripheries with sealing material (not shown) so as to form a plurality of discharge cells inside.

Front plate 20 has glass-made front substrate 21, display electrodes 24 formed of scan electrodes 22 and sustain electrodes 23, dielectric layer 26, and protective layer 27. On front substrate 21, display electrodes 24, each of which is a pair of scan electrode 22 and sustain electrode 23, are formed in parallel with each other. Although FIG. 1 shows an arrangement of display electrodes 24 where scan electrode 22, sustain electrode 23, scan electrode 22, sustain electrode 23 are alternately disposed, the present invention is not limited to this arrangement; display electrodes 24 may be arranged in the following order: scan electrode 22, sustain electrode 23, sustain electrode 23, scan electrode 22, and so on.

Dielectric layer 26 is formed so as to cover display electrodes 24, and protective layer is formed over dielectric layer 26. Protective layer 27 is a magnesium oxide (MgO)-based film made by sputtering or vapor deposition.

Back plate 30 has glass-made back substrate 31, data electrodes 32, dielectric layer 33, barrier ribs 34, and phosphor layers 35. On back substrate 31, a plurality of data electrodes 32 is formed in parallel with each other. Dielectric layer 33 is formed so as to cover data electrodes 32, and grid-like barrier ribs 34 having vertical ribs 34*a* and horizontal ribs 34*b* are formed on dielectric layer 33. In addition, phosphor layers 35 of red, green, and blue are formed on the surface of dielectric layer 33 and on the side surface of barrier ribs 34.

Front plate 20 and back plate 30 are oppositely disposed so that display electrodes 24 are located orthogonal to data electrodes 32. Discharge cells are formed at which display electrodes 24 face data electrodes 32. Front plate 20 and back plate 30 are sealed with low-melting-point glass at the peripheries outside the image display area in which the discharge cells are formed. The discharge space is filled with discharge gas.

As described above, panel 10 of the embodiment has front plate 20 provided with the following components: front substrate 21; display electrodes 24 formed on front substrate 21; dielectric layer 26 covering display electrodes 24; and protective layer 27 covering dielectric layer.

In manufacturing panel 10 with the structure above, protective layer 27 of front plate 20 is exposed to water ($H_2O$) or carbon dioxide ($CO_2$) in the following processes: a heating/baking process for degassing front plate 20 after protective layer 27 has been formed thereon by sputtering or vapor deposition, and a sealing process for sealing front plate 20 and back plate 30 with sealing material.

Magnesium oxide (MgO), which is the material of protective layer 27, easily reacts with water and carbon dioxide ($CO_2$) and often undergoes a chemical change through the processes mentioned above, causing some problems below.

For example, through the reaction with water ($H_2O$), magnesium oxide (MgO) can partially change into magnesium hydroxide ($Mg(OH)_2$). If it occurs, resistance to sputtering of protective layer 27 can deteriorate, shortening the life of a panel as an image display device. As another case, through the reaction with carbon dioxide ($CO_2$), magnesium oxide (MgO) can partially change into magnesium carbonate ($MgCO_3$). This causes increase in discharge start voltage, which can invite serious reduction in luminance and shortened life as an image display device.

Conducting a study on the aforementioned inconveniencies, the inventors have acquired the findings below. As described above, binding with water (H2O) or carbon dioxide ($CO_2$) changes magnesium oxide (MgO) as the material of protective layer 27 into magnesium hydroxide ($Mg(OH)_2$) or magnesium carbonate ($MgCO_3$), respectively. Even if it has occurred, application of heat with temperature exceeding 400° C. can break the bonding. That is, the material of protective layer 27 gets back to the original form as magnesium oxide (MgO). In an atmosphere with temperature exceeding 400° C., even if water ($H_2O$) and carbon dioxide ($CO_2$) are found there, they cannot bond with magnesium oxide (MgO). However, the temperature decreases to 400° C. or less, magnesium oxide (MgO) bonds with water ($H_2O$) or carbon dioxide ($CO_2$) and changes into magnesium hydroxide ($Mg(OH)_2$) or magnesium carbonate ($MgCO_3$).

The study shows that, for protecting magnesium oxide (MgO) of completed protective layer 27 from change in quality, it should be processed in an $H_2O$-free or $CO_2$-free atmosphere only for a period with a temperature of 400° C. or lower. When there is a period with temperature exceeding 400° C. somewhere in the manufacturing process, the $H_2O$-free or $CO_2$-free atmosphere should be maintained only for a period with a temperature of 400° C. or lower in the cooling period that follows the high-temperature period.

In the manufacturing process of panel 10, the heat history on front plate 20 after protective layer 27 has been formed is determined by the processes below for the purpose of protecting magnesium oxide (MgO) from change in quality. Each of FIG. 2 through FIG. 4 shows a heat history profile that front plate 20 undergoes after the protective layer has been formed thereon in the method for manufacturing panel 10 in accordance with the exemplary embodiment of the present invention.

Figure 2:
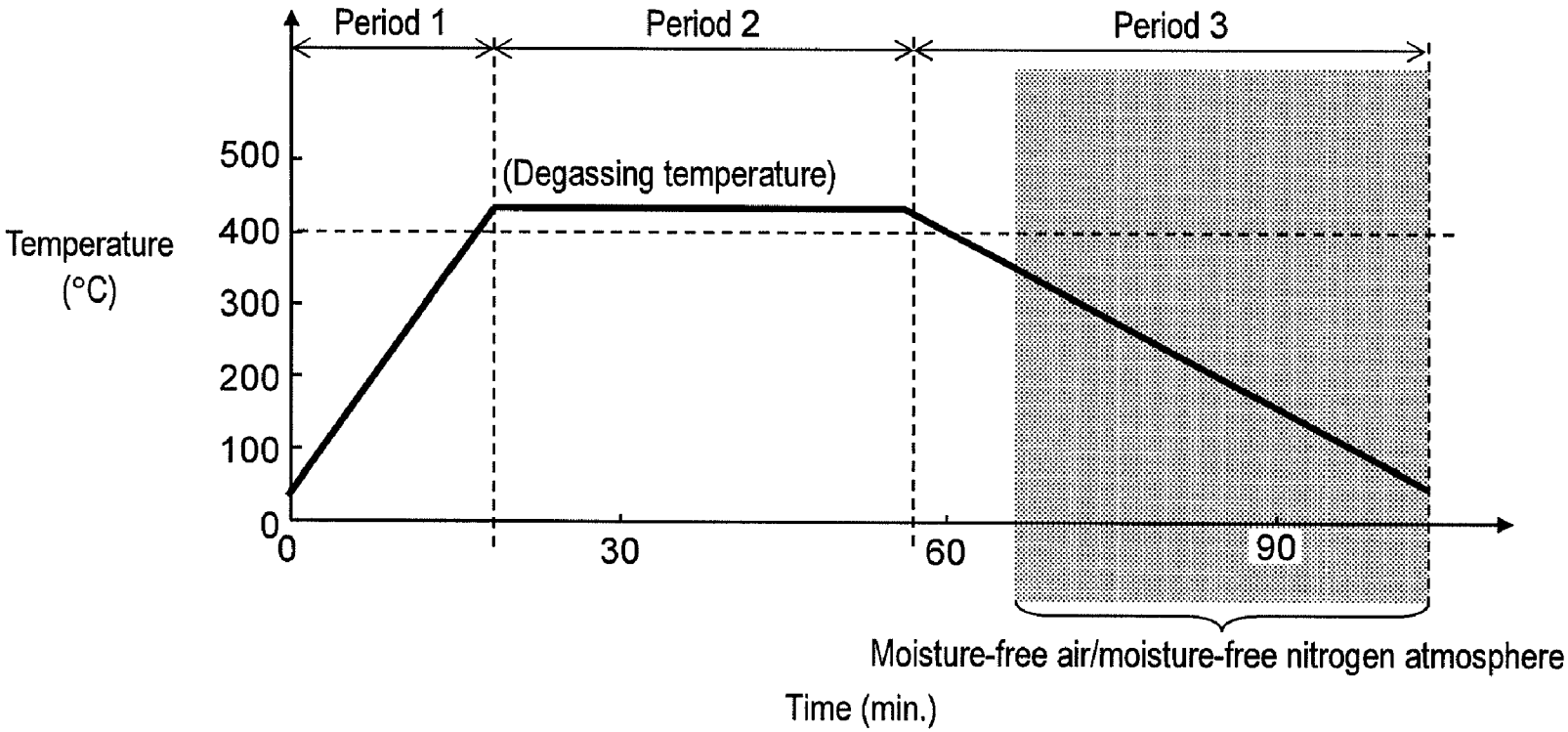
FIG. 2 shows a heat history profile that the front plate undergoes after the protective layer has been formed in the method of manufacturing the panel in accordance with the exemplary embodiment of the present invention.
Figure 3:
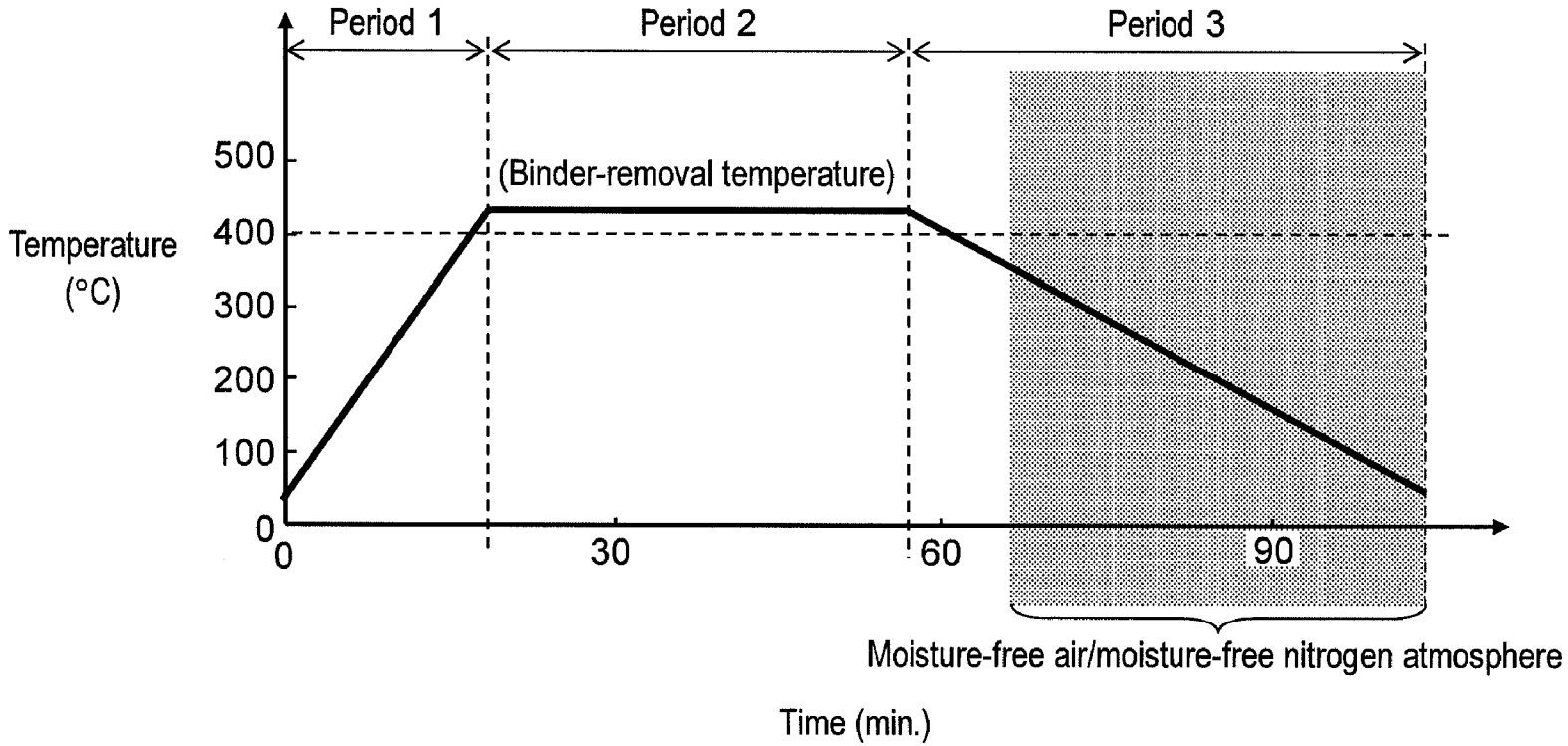
FIG. 3 shows another heat history profile that the front plate undergoes after the protective layer has been formed in the method of manufacturing the panel in accordance with the exemplary embodiment of the present invention.

FIG. 2 shows a heat history profile for a pre-baking process for degassing, i.e., for removing impurity gases attached to protective layer 27 in the forming process of protective layer 27.

After protective layer 27 has been formed, sealing material is applied to front plate 20 and undergoes a binder-removal process where resin component of the sealing material is baked, prior to a sealing process where front plate 20 and back plate 30 are sealed with the sealing material. FIG. 3 shows a heat history profile for the binder-removal process.

Figure 4:
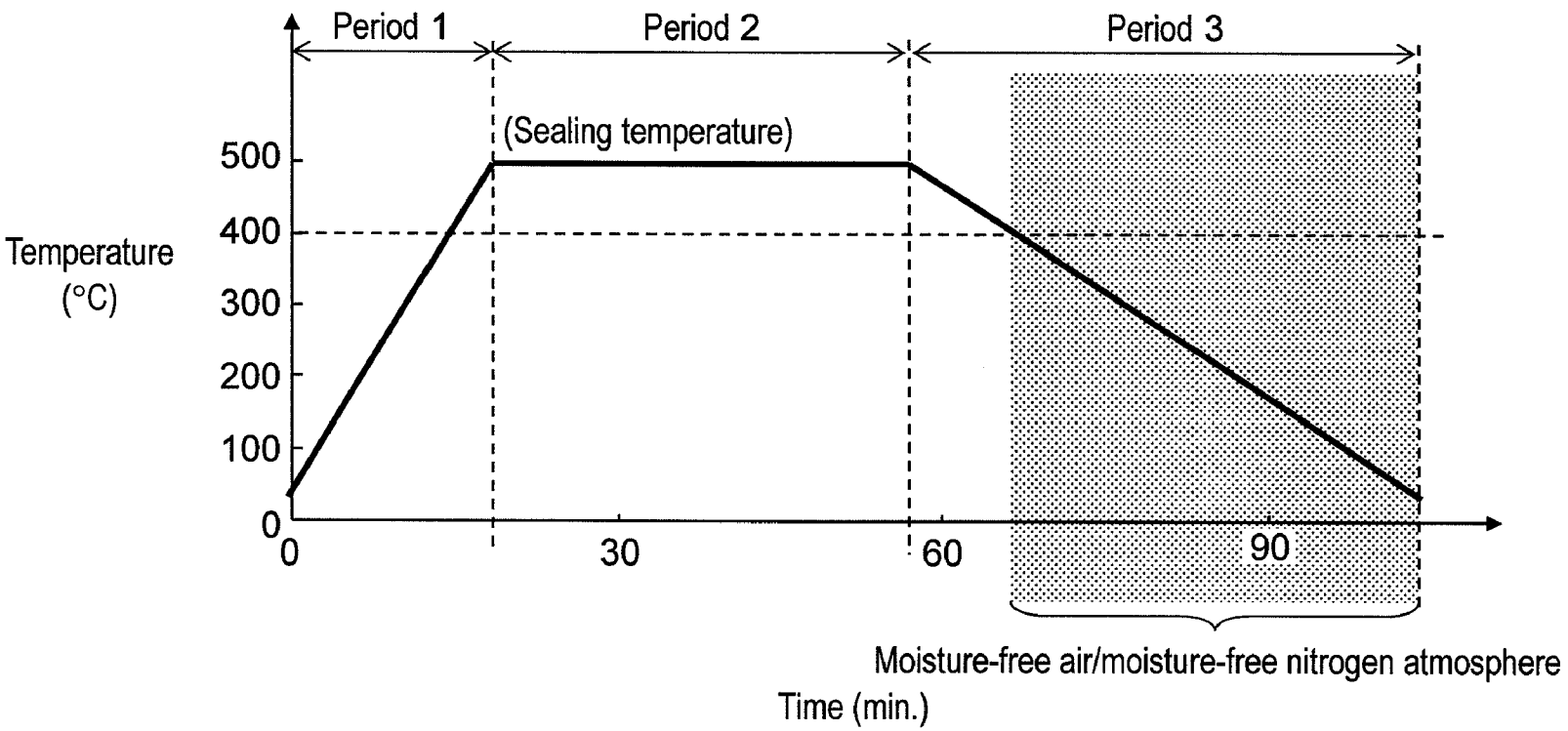
FIG. 4 shows still another heat history profile that the front plate undergoes after the protective layer has been formed in the method of manufacturing the panel in accordance with the exemplary embodiment of the present invention.

FIG. 4 shows a heat history profile for the sealing process for sealing front plate 20 and back plate 30 with sealing material.

According to the pre-baking process shown in FIG. 2, in period 1, the temperature is increased to a predetermined degassing temperature—at least higher than 400° C.—that enables impurity gases to be removed from protective layer 27. In period 2, protective layer 27 undergoes the degassing process while the predetermined temperature (i.e., the degassing temperature) is kept for the period. After that, the predetermined degassing temperature is decreased to room temperature in period 3.

In period 3, only for a period with a temperature of 400° C. or lower in the cooling period, front plate 20 is kept in the $H_2O$-free atmosphere or $CO_2$-free atmosphere.

Employing the heat history profile above allows impurity gases, such as water and carbon dioxide, to be removed from protective layer 27 in period 2, at the same time, the heat history profile prevents the impurity gases from sticking again to protective layer 27 in the cooling period in period 3. As a result, front plate 20 undergoes the pre-baking process without degradation of magnesium oxide (MgO) of protective layer 27.

According to the binder-removal process shown in FIG. 3, in period 1, the temperature is increased to a predetermined binder-removal temperature—usually, exceeding 400°

C.—enough for baking resin component of sealing material. In period 2, resin component of sealing material is baked and the surface of frit glass is slightly softened while the predetermined temperature is kept for the period. In period 3, the predetermined binder-removal temperature is decreased to room temperature to harden the surface of frit glass. This prevents peeling-off of frit glass or generation of frit-glass dust that can occur in the sealing process of the front plate and the back plate.

In period 3, only for a period with a temperature of 400° C. or lower in the cooling period, front plate 20 is kept in the $H_2O$-free atmosphere or $CO_2$-free atmosphere.

In period 2, employing the heat history profile above allows resin component of sealing material to be baked, but also allows impurity gases, such as water and carbon dioxide, to be removed from protective layer 27. Further, in period 3, employing the profile prevents the impurity gases from sticking again to protective layer 27. As a result, front plate 20 undergoes the binder-removal process without degradation of magnesium oxide (MgO) of protective layer 27.

According to the sealing process shown in FIG. 4, in period 1, the temperature is increased to a predetermined sealing temperature—usually, exceeding 400° C. and higher than the binder-removal temperature described above—that enables sealing material to seal front plate 20 with back plate 30. In period 2, the front plate and the back plate are sealed, i.e., joined together while the predetermined temperature is kept for the period. In period 3, the predetermined sealing temperature is decreased to room temperature.

In period 3, only for a period with temperature of 400° C. or lower in the cooling period, front plate 20 is kept in the $H_2O$-free atmosphere or $CO_2$-free atmosphere.

Employing the heat history profile above, in period 2, not only allows the resin material to have a proper temperature for sealing front plate 20 and back plate 30 with each other, but also allows impurity gases, such as water and carbon dioxide, to be removed from protective layer 27. Further, in period 3, employing the profile prevents the impurity gases from sticking again to protective layer 27. As a result, front plate 20 undergoes the sealing process without degradation of magnesium oxide (MgO) of protective layer 27.

After the completion of the sealing process, protective layer 27 has an exposure in only discharge cells divided by barrier ribs 34 inside panel 10, that is, the chance that protective layer 27 is exposed in the atmosphere outside panel 10 is slim. The structure having undergone the sealing process significantly retards degradation of magnesium oxide (MgO) of protective layer 27, compared to that before the sealing process.

After the sealing process above, the inside of panel 10 is evacuated of the air in an evacuation/baking process and then filled with discharge gas to complete panel 10. The processes above allows panel 10 to have stabilized characteristics of protective layer 27, enhancing the quality of image display.

According to the embodiment of the present invention, employing all of the pre-baking process, the binder-removal process, and the sealing process described with reference to FIGS. 2 through 4 is most effective in enhancing the stability of characteristics of protective layer 27. That is, all the processes should preferably be employed for manufacturing panel 10 with excellent image display. However, it is also effective that making a choice—for example, employing only the sealing process as the final process—depending on circumstances.

To prevent degradation of magnesium oxide (MgO) of protective layer 27, as described above, the front plate on which protective layer 27 has been formed is processed in an $H_2O$-free atmosphere or in a $CO_2$-free atmosphere. Specifically, the $H_2O$-free or $CO_2$-free atmosphere is maintained for only a period with a temperature of 400° C. or lower in the cooling process where the front plate is cooled down to room temperature after having undergone a period with temperatures exceeding 400° C. at which carbon dioxide ($CO_2$) and water ($H_2O$) cannot bond with magnesium oxide (MgO).

In other words, atmosphere control does not need for the temperature-increasing period from room temperature and the high-temperature period exceeding 400° C. but need only for the period with a temperature of 400° C. or lower in the cooling period. Employing gas for atmosphere control in the temperature-increasing period or high-temperature period often brings difficulty in temperature control. The atmosphere control of the embodiment is effective in eliminating the problem above.

The $H_2O$-free atmosphere in the description means the atmosphere with humidity of nearly 0%, such as a moisture-free air atmosphere with a dew point of −40° C. or lower and a moisture-free nitrogen atmosphere with a dew point of −40° C. or lower.

According to the embodiment, it is important that front plate 10 on which protective layer 27 has been formed is processed in an $H_2O$-free atmosphere or in a $CO_2$-free atmosphere only for a period with a temperature of 400° C. or lower in the cooling period. Preferably, front plate 10 should be heated as high as exceeding 400° C. after protective layer 27 has been formed thereon, and in the subsequent cooling period, front plate 10 should be cooled down to room temperature in an $H_2O$-free atmosphere or in a $CO_2$-free atmosphere only for the period with a temperature of 400° C. or lower.

The $CO_2$-free atmosphere described above means, for example, a moisture-free nitrogen atmosphere or a nitrogen atmosphere having at least following conditions: a dew point of −40° C. or lower and $CO_2$ concentration of 0.1% or lower; more preferably, 0.001% or lower.

According to the method for manufacturing a panel of the embodiment, front plate 20 has the following heat history after protective layer 27 has been formed thereon; front plate 20 is cooled down to room temperature in the $H_2O$-free or $CO_2$-free atmosphere for only the period with a temperature of 400° C. or lower in the cooling process. This contributes to easy temperature control of front plate 20 in the heating process. At the same time, it is effective in preventing magnesium oxide (MgO) from degradation. As a result, this not only allows protective layer 27 to have enhanced resistance to sputtering, but also suppresses increase in discharge start voltage and therefore suppresses decrease in luminance. Conventionally, for removing $H_2O$ or $CO_2$ from MgO, i.e., for degassing, the inside of a panel has been evacuated with application of heat exceeding 400° C. in the sealing process before being filled with discharge gas. According to the method of the present invention, however, the aforementioned characteristics of the panel is obtained by application of heat with temperatures between 100-300° C.

Second Exemplary Embodiment

In the first exemplary embodiment, the description is given on protective layer 27 made of magnesium oxide (MgO) film by sputtering or vapor deposition. However, it is not limited to; even in a case where protective layer 27 is formed by coating magnesium oxide (MgO) particles, the effect similar to that described in the first exemplary embodiment is obtained by employing the pre-baking process (FIG. 2), the binder-removal process (FIG. 3), and the sealing process (FIG. 3) in the panel manufacturing process.

In protective layer 27 having the particle-layer structure described above, an amount of water ($H_2O$) or carbon dioxide ($CO_2$) stuck to magnesium oxide (MgO) increases because of its increased surface area, which increases tendency to degradation of magnesium oxide (MgO). However, in this case, too, processing the front plate after the protective layer has been formed thereon with the heat history described above effectively removes water ($H_2O$) or carbon dioxide ($CO_2$) from magnesium oxide (MgO) and prevents reattachment of them to MgO. As a result, in protective layer 27 with a MgO-based particle-layer structure, degradation of MgO is significantly suppressed. An MgO-based nanocrystalline particle with an average particle diameter of 10-100 nm is a specific example of magnesium oxide (MgO) particles.

Hereinafter, a method for forming protective layer 27 made of the aforementioned nanocrystalline-particle layer will be described in detail. First, single-crystal particles with an average particle diameter of 10-100 nm (i.e., nanocrystalline particles) are formed by a gaseous-phase generation method. Specifically, the nanocrystalline particles are generated in a manner that magnesium is vaporized in a high-energy environment, such as plasma and electronic beams, and the magnesium vapor is instantaneously cooled by a cooling gas including oxygen gas (for example, argon gas). Next, magnesium-oxide paste is generated by mixing the nanocrystalline particles into a vehicle formed of 60 wt % terpineol, 30 wt % butyl carbitol acetate, and 10 wt % acrylic resin so that the paste and the vehicle are equivalent in weight. The magnesium-oxide paste is coated on dielectric layer 26 by screen printing or other heretofore known techniques. After that, the paste is dried and then baked so as to be formed into protective layer 27 made of nanocrystalline-particle layers with a thickness of 0.5-5 μm.

When protective layer 27 has the aforementioned nanocrystalline-particle layer structure, the baking process—where coated and dried magnesium-oxide paste is baked—is added to the pre-baking process, the binder-removal process, and the sealing process described in the first exemplary embodiment. In the baking process, too, employing the heat history profile shown in FIG. 5 effectively allows protective layer 27 to have stable characteristics. As a result, panel 10 offers excellent image display. Protective layer 27, as described above, may be formed of MgO-based crystal particles with an average particle diameter of 10-100 nm.

Figure 5:
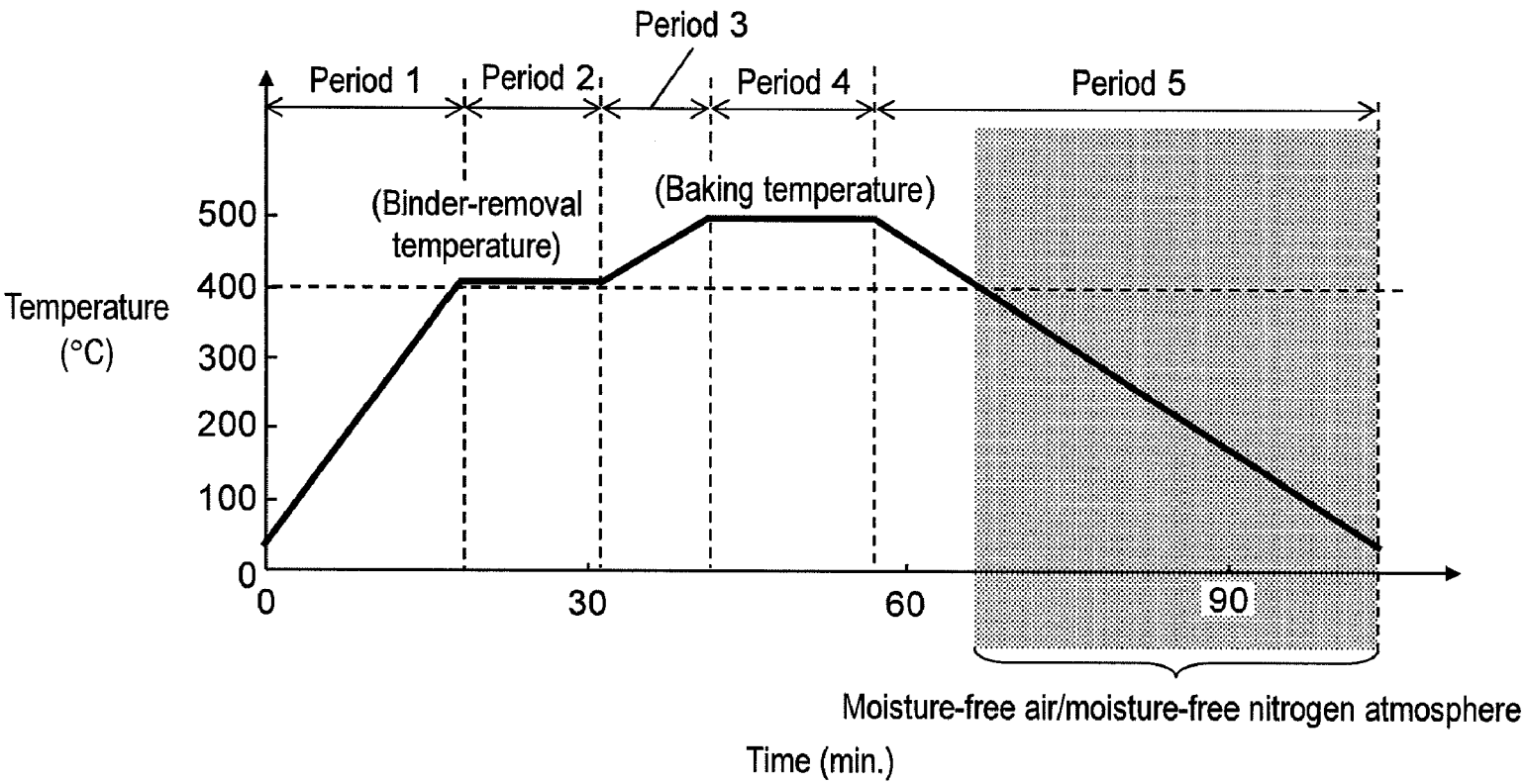
FIG. 5 shows yet another heat history profile that the front plate undergoes after the protective layer has been formed in the method of manufacturing the panel in accordance with the exemplary embodiment of the present invention.

FIG. 5 shows a heat history profile for the baking process. In period 1, the temperature is increased to a predetermined temperature—usually, at least exceeding 400° C. enough for baking the resin component of the magnesium-oxide paste. In period 2, the resin component is baked while the predetermined temperature is kept for the period. The predetermined temperature is further increased to the baking temperature in period 3. In period 4, the resin component of the magnesium-oxide paste, which has baked in the period 2, is baked again while the baking temperature is kept for the period. In period 5, the baking temperature is decreased to the predetermined temperature and then further down to room temperature.

In period 5 above, only for the period with a temperature of 400° C. or lower in the cooling period, front plate 20 is kept in the $H_2O$-free atmosphere or $CO_2$-free atmosphere.

Employing the heat history profile above not only allows magnesium-oxide paste to be baked but also allows impurity gases to be removed from protective layer 27. At the same time, this prevents reattachment of the impurity gases, such as water and carbon dioxide, to protective layer 27 in the cooling period in period 5. As a result, front plate 20 undergoes the baking process without degradation of magnesium oxide (MgO) of protective layer 27.

According to the embodiment of the present invention, employing all of the pre-baking process, the binder-removal process, the sealing process, and the baking process described above is most effective in enhancing the stability of characteristics of protective layer 27. That is, all the processes should preferably be employed for manufacturing panel 10 with excellent image display. However, it is also effective that making a choice—for example, employing only the sealing process as the final process—depending on circumstances.

Compared to the protective layer made of a magnesium-oxide thin film by sputtering or vapor deposition, employing the structure of the aforementioned nanocrystalline-particle layer contributes to cost-reduced protective layer 27. Besides, as an additional effect, an improvement in panel strength against impact is expected.

The method of the embodiment offers protective layer 27 formed of nanocrystalline-particle layer that enhances panel strength against impact, with degradation of magnesium oxide (MgO) suppressed. That is, the method of the embodiment minimizes the likelihood that magnesium oxide (MgO) is partially changed to magnesium hydroxide ($Mg(OH)_2$) in a reaction with water ($H_2O$) or that magnesium oxide (MgO) is partially changed to magnesium carbonate ($MgCO_3$) in a reaction with carbon dioxide ($CO_2$). No degradation in MgO enhances the resistance to sputtering of protective layer 27, providing the panel with long life as an image display device. Besides, the panel with the protective layer having the structure above has no increase in discharge start voltage and therefore no decrease in luminance.

The aforementioned structure of the embodiment imposes no specific limitation on each structure of the scan electrode and the sustain electrode; each of the electrodes may be formed of the structure where a bus electrode shaped into narrow-width stripes is disposed on a transparent electrode shaped into wide-width stripes, or may be formed differently.

Figure 6B:
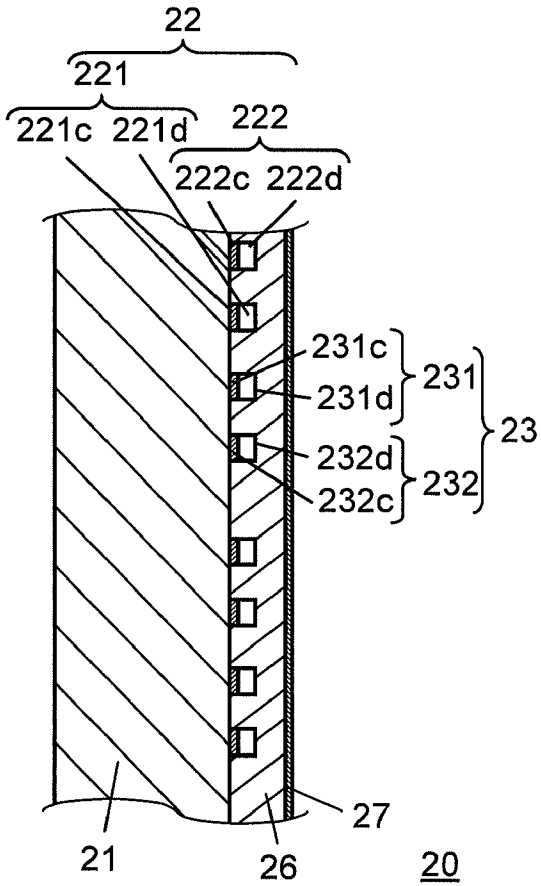
FIG. 6B is a sectional view showing the structure of display electrodes of a panel in accordance with another exemplary embodiment of the present invention.
Figure 6A:
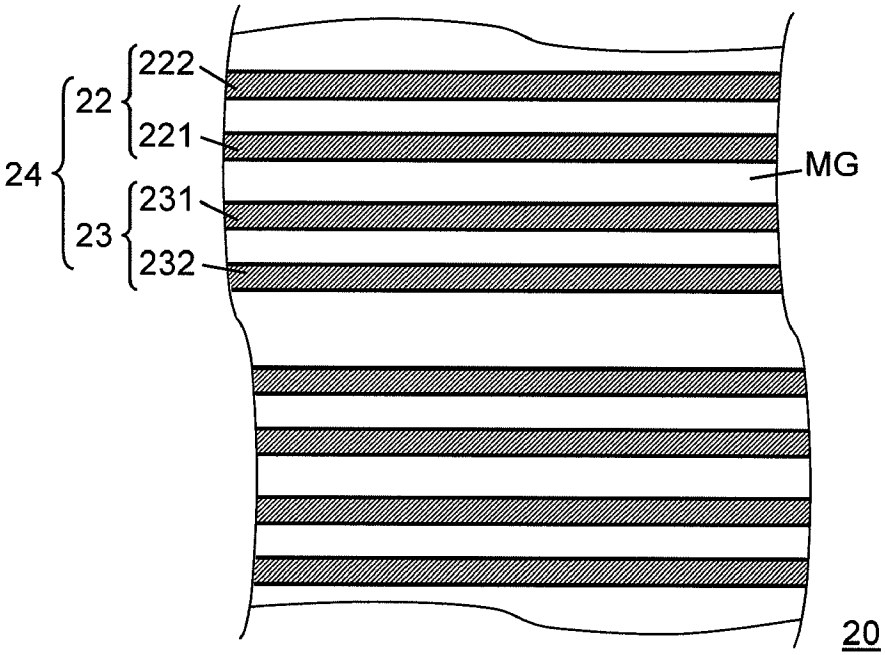
FIG. 6A is a front view showing the structure of display electrodes of a panel in accordance with another exemplary embodiment of the present invention.
Figure 7:
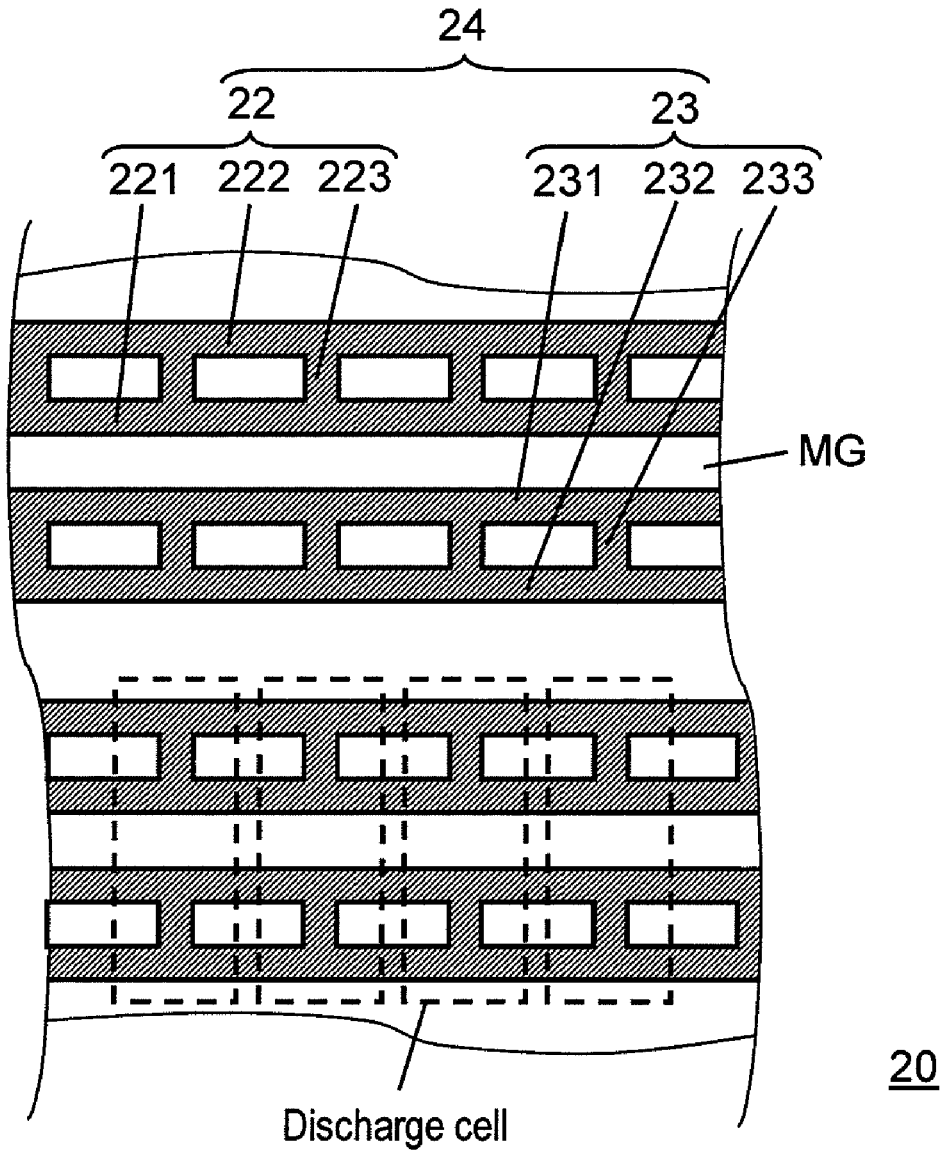
FIG. 7 shows a detail of display electrodes of a panel in accordance with another exemplary embodiment of the present invention.

FIG. 6A is a front view showing the structure of display electrodes 24 of panel 10 in accordance with another exemplary embodiment of the present invention. FIG. 6B is a sectional view showing the structure of display electrodes 24 of panel 10 in accordance with another exemplary embodiment of the present invention. FIG. 7 shows a detail of display electrodes 24 of panel 10 in accordance with another exemplary embodiment of the present invention. Display electrodes 24 may be formed of the structure shown in FIG. 6A and FIG. 6B; scan electrodes 221 and 222 are formed in a manner that conductive layers 221*d* and 222*d* are disposed on black layers 221*c* and 222*c*, respectively. Similarly, sustain electrodes 231 and 232 are formed in a manner that conductive layers 231*d* and 232*d* are disposed on black layers 231*c* and 232*c*, respectively. Scan electrodes 221, 222 and sustain electrodes 231, 232 are arranged via discharge gap MG. The structure shown in FIG. 7 is another structure of display electrodes 24; bus electrodes 221 and 231, each of which corresponds to one of two long bars of a "ladder", define discharge gap MG. Bus electrodes 222 and 232, each of which corresponds to the other of the long bars of the ladder, enhance of the conductivity of the sustain electrodes. Bus electrodes 223 and 233 correspond to a "step" of the ladder. Bus electrode 223 reduces resistance between bus electrodes 221 and 222; similarly, bus electrode 233 reduces resistance between bus electrodes 231 and 232.

According to the structure—where display electrode 24 is formed of bus electrodes 221, 222, 231, and 232—shown in FIG. 6 and FIG. 7, display electrode 24 has a thickness of 1-6

μm. In the structure of the embodiment, the thickness measures approx. 4 μm. Due to the difference in thickness, dielectric layer 26 has irregularities on the surface around discharge gap MG.

Figure 8:
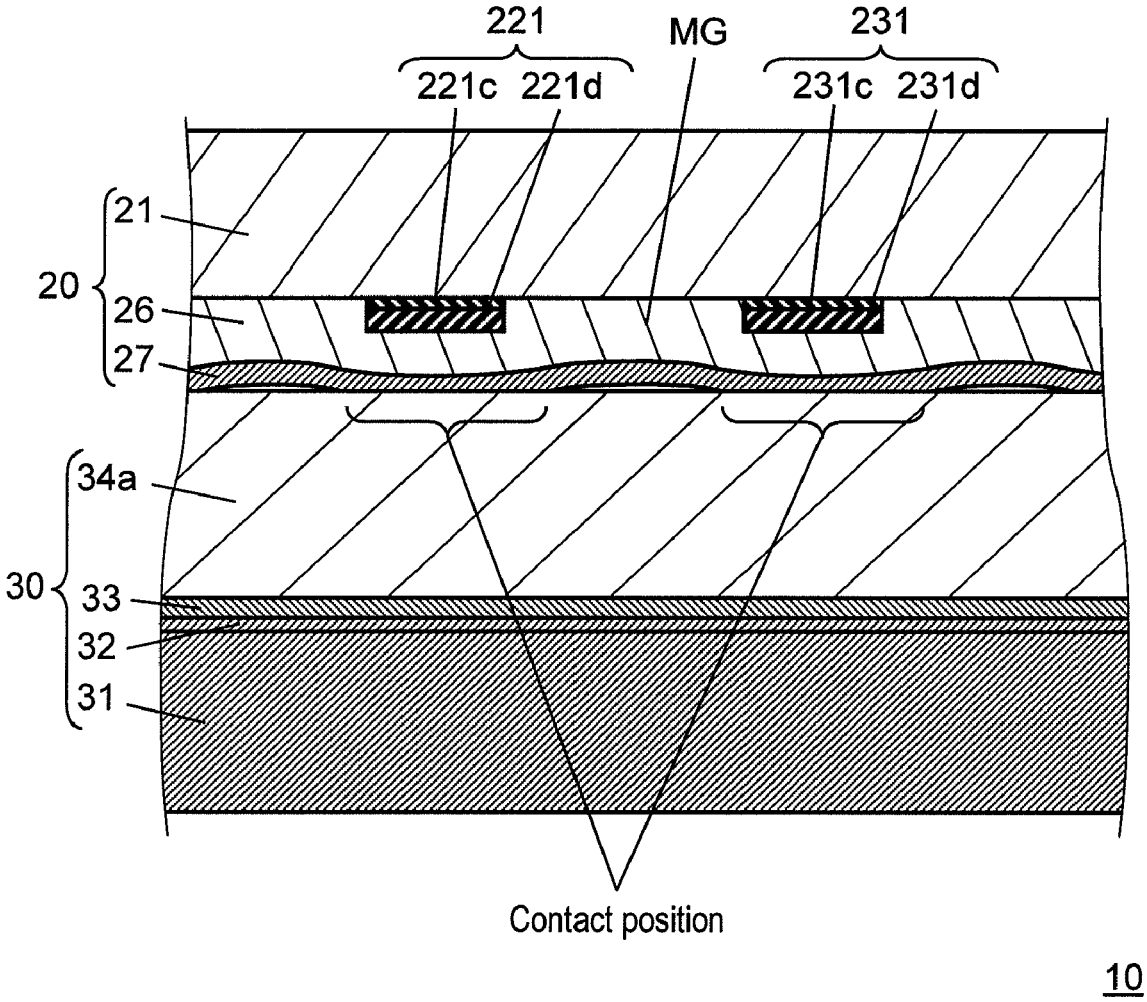
FIG. 8 is a sectional view of a panel in accordance with another exemplary embodiment of the present invention.

FIG. 8 is a sectional view of panel 10 in accordance with another exemplary embodiment of the present invention. Specifically, it shows an enlarged section at around discharge gap MG, which is parallel to data electrodes 32. As described above, the surface of dielectric layer 26 has irregularities, i.e., difference in level of approx. 2 μm. When front plate 20 and back plate 30 are oppositely arranged, protective layer 27 makes contact with vertical ribs 34*a* at a "bump" section—where bus electrodes 221 and 231 are disposed—of dielectric layer 26.

In the structure above, protective layer 27 has not a point contact with vertical ribs 34*a* but an area contact with ribs 34*a* as a result of deformed protective layer 27 pushed by vertical ribs 34*a*. By virtue of the area contact, a stress applied to vertical ribs 34*a* disperses, decreasing the risk of damage to vertical ribs 34*a*.

If the protective layer has high rigidity, it will make a point contact with the vertical ribs, exerting a large stress on the contact position, by which the vertical ribs can be damaged. If it occurs around a discharge gap, broken pieces of the vertical ribs can scatter inside the discharge cell. Besides, it can invite peel-off of the phosphor layers. These damages cause serious degradation in discharge characteristics of the discharge cell, resulting in abnormal discharge operations.

According to the embodiment, however, protective layer 27 is made of MgO-based nanocrystalline-particle layers having a thickness nearly the same as the difference in level caused by irregularities of the surface of dielectric layer 26. By virtue of the structure, on the position at which protective layer 27 makes contact with vertical ribs 34*a*, the surface of protective layer 27 has irregularities as a result of being pushed by vertical ribs 34*a*. This allows protective layer 27 and vertical ribs 34*a* to have an area contact, thereby protecting vertical ribs 34*a* from application of large stress, and therefore from damage.

As described above, employing nanocrystalline-partcle layers for protective layer 27 offers the following additional effects. Protective layer 27 with a flexible structure has an area contact—not a point contact—with vertical ribs 34*a*. That is, no increase in stress on vertical ribs 34, protecting it from damages.

Figure 9:
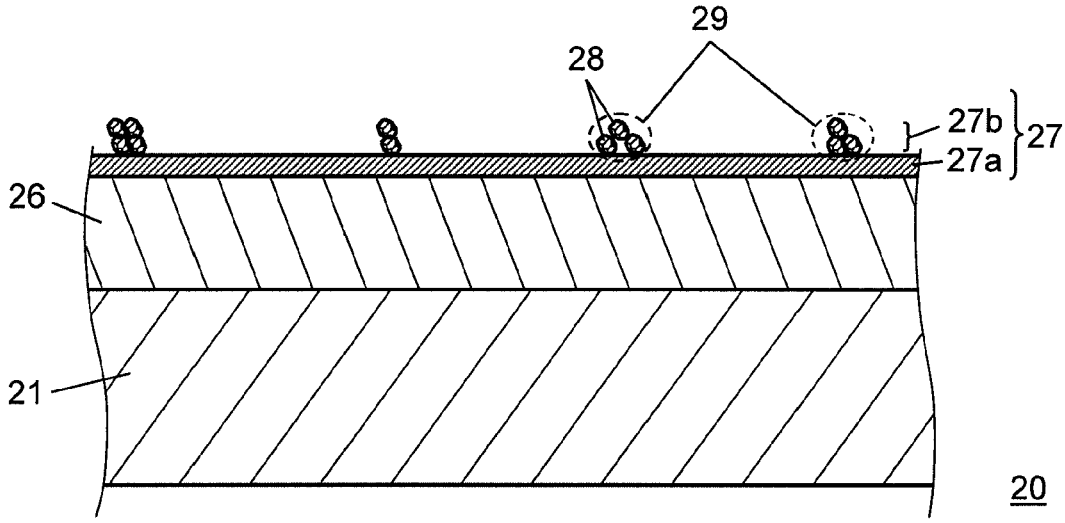
FIG. 9 shows an enlarged section of the front plate of a panel in accordance with still another exemplary embodiment of the present invention.

Protective layer 27 may be formed of base protective layer 27*a* and particle layer 27*b*. Base protective layer 27*a* is made of MgO-based crystal particles with an average particle diameter of 10-100 nm. Particle layer 27*b* is an aggregated structure of a plurality of MgO single-crystal particles with particle diameter of 0.3-2 μm. FIG. 9 shows an enlarged section of the front plate of a panel in accordance with still another exemplary embodiment of the present invention.

Particle layer 27*b* is formed in a manner that aggregated particles 29 of a plurality of MgO single-crystal particles 28 are stuck to base protective layer 27*a* (that is made of single-crystal particles 28 with an average particle diameter of 10-100 nm) so as to have uniform distribution over the entire surface. FIG. 9 is an enlarged view of single-crystal particles 28 and aggregated particles 29. Aggregated particles 29 is an aggregate of a plurality of single-crystal particles 28 that are aggregated or necked by static electricity, van der Waals force, or the like. Preferably, single-crystal particles 28 are shaped into a polyhedron having at least seven faces, such as a tetradecahedron and dodecahedron, and have particle diameters ranging from approximately 0.3 to 2.0 μm. Preferably, in aggregated particles 29, two to five single-crystal particles 28 are aggregated. Preferably, aggregated particles 29 have particle diameters ranging from approximately 0.3 to 5 μm. Such structured single-crystal particles 28 and aggregated particles 29 offer high electron emission, providing a panel with small delay in discharge and with high-speed discharge control. This advantage is particularly useful for a high-definition panel where a plurality of discharge cells needs to be controlled at high speed.

Single-crystal particles 28 and aggregated particles 29 made of the aggregated single-crystal particles that satisfy the above conditions can be produced in the following manner. When a magnesium oxide (MgO) precursor, such as magnesium carbonate ($MgCO_3$) and magnesium hydrate ($Mg(OH)_2$), is baked to provide particles, the particle diameter can be controlled approximately in a range of 0.3 to 2 μm by setting a relatively high temperature of at least 1000° C. Further, baking the magnesium oxide (MgO) precursor provides aggregated particles 29 in which single-crystal particles 28 are aggregated or necked with each other.

Processing such structured protective layer with the heat history described in the present invention protects magnesium oxide (MgO) from degradation, allowing a panel to maintain high performance in electron emission and charge retention.

Specific values seen throughout the description and the drawings of the embodiment are cited merely by way of example and without limitation. They should be optimally determined according to characteristics and specifications of a panel.

INDUSTRIAL APPLICABILITY

The present invention is thus useful for providing a high-definition plasma display device with a large screen.

The invention claimed is:

1. A method for manufacturing a plasma display panel having a front plate provided with a front substrate, a display electrode formed on the front substrate, a dielectric layer covering the display electrode, a protective layer covering the dielectric layer, and a back plate sealed with a sealing material to the front plate, the method comprising:

any one of (i) removing impurity gases attached to the protective layer, (ii) baking a resin component of the sealing material, and (iii) sealing the front plate and the back plate with the sealing material, wherein, in the at least one of the removing, baking, and sealing, a temperature of the front plate is decreased to 400° C. or lower after the temperature of the front plate is increased to at least higher than 400° C., and wherein the front plate is kept in an $H_2O$ free atmosphere for only a period with the temperature of the front plate being 400° C. or lower.

2. The method for manufacturing a plasma display panel according to claim 1, wherein the $H_2O$-free atmosphere is any one of (i) a moisture-free air atmosphere with a dew point of −40° C. or lower and (ii) a moisture-free nitrogen atmosphere with a dew point of −40° C. of lower.

3. A method for manufacturing a plasma display panel having a front plate provided with a front substrate, a display electrode formed on the front substrate, a dielectric layer covering the display electrode, a protective layer covering the dielectric layer, and a back plate sealed with a sealing material to the front plate, the method comprising:

any one of (i) removing impurity gases attached to the protective layer, (ii) baking a resin component of the sealing material, and (iii) sealing the front plate and the back plate with the sealing material, wherein, in the at least one of the removing, baking, and sealing, a temperature of the front plate is decreased to 400° C. or lower after the temperature of the front plate is increased to at least higher than 400° C., and wherein the front plate is kept in a carbon-dioxide-free atmosphere for only a period with the temperature of the front plate being 400° C. or lower.

4. The method for manufacturing a plasma display panel according to claim 3, wherein the carbon-dioxide-free atmosphere is any one of a moisture-free nitrogen atmosphere or a nitrogen atmosphere having a dew point of −40° C. or lower and a $CO_2$ concentration of 0.1%.

5. The method for manufacturing a plasma display panel as in one of claims 1-4, wherein the protective layer includes crystal particles with an average particle diameter of 10-100 nm, the crystal particles including magnesium-oxide.

6. The method for manufacturing a plasma display panel as in one of claims 1-4, wherein the protective layer includes (i) layer of crystal particles with an average particle diameter of 10-100 nm, the crystal particles with the average particle diameter of 10-100 nm including magnesium-oxide, and (ii) a layer of aggregated particles as an aggregate of a plurality of crystal particles with a particle diameter of 0.3-2 μm, the crystal particles with the particle diameter of 0.3-2 μM including magnesium-oxide.

* * * * *